US005117650A

United States Patent [19]

Kim

[11] Patent Number: 5,117,650

[45] Date of Patent: Jun. 2, 1992

[54] PLASTIC PAN ASSEMBLY FOR USE IN AIR CONDITIONERS AND REFRIGERATORS

[75] Inventor: Il Yoo Kim, Alexandria, Va.

[73] Assignee: Permanent Solution Industries, Inc., Falls Church, Va.

[21] Appl. No.: 572,865

[22] Filed: Aug. 27, 1990

[51] Int. Cl.[5] ..... F25D 21/14

[52] U.S. Cl. ..... 62/285; 62/291

[58] Field of Search ..... 62/272, 285, 286, 288, 62/289, 291

[56] References Cited

U.S. PATENT DOCUMENTS

| | | | |
|---|---|---|---|
| 4,597,269 | 7/1986 | Kim | 62/286 |
| 4,823,558 | 4/1989 | Kim | 62/272 |
| 4,862,704 | 9/1989 | Kim | 62/272 |
| 4,893,481 | 1/1990 | Sullivan | 62/291 |
| 4,916,919 | 4/1990 | Kim | 62/272 |
| 4,970,875 | 11/1990 | Kim | 62/272 |
| 4,974,421 | 12/1990 | Kim | 62/272 |
| 4,986,087 | 1/1991 | Sullivan | 62/291 |

*Primary Examiner*—William E. Tapolcai

*Attorney, Agent, or Firm*—Birch, Stewart, Kolasch & Birch

[57] ABSTRACT

A primary pan assembly for use in conjunction with an air conditioning system, which includes two primary plates and a silicon rubber cover which are assembled together to form the primary pan which includes a lower cylinder to be disposed at the assembled pan during installation thereof so as to pass a pair of built drain pipes through the lower cylinder, whereby the plastic primary pan can easily be assembled with the silicone rubber plate and tightly attached to the pair of built drain pipes.

7 Claims, 2 Drawing Sheets 5
5
10
11
12
13
14
15
16
17
18
19
20
20'
21
22
23
25
26
27
28
29

PLASTIC PAN ASSEMBLY FOR USE IN AIR CONDITIONERS AND REFRIGERATORS

BACKGROUND OF THE INVENTION

1. Field of the Invention

The present invention relates to a primary pan assembly for use in conjunction with air conditioning installations and refrigeration systems. More particularly, the present invention relates to a plastic primary pan assembled with two primary plates and a silicone rubber cover which are assembled together to form the primary pan which includes a lower cylinder to be disposed at the assembled pan during installation thereof so as to pass a pair of built drain pipes through the lower cylinder.

2. Description of the Prior Art

Primary pans are generally known to be utilized with air conditioning systems. Conventional devices utilize a primary pan made of steel which is directly mounted to a fan cover and a motor. However, these devices suffer from a number of problems such as, for example, the problem that metallic primary pans eventually become rusted and plug up outlets for draining water from the pan. Further, it is difficult for the pan to support the air condition system such as the motor and the pan cover, because of the additional weight caused by the metal pan, so that the motor cannot be used for a long time. It is also very difficult for the primary pans to separate from such devices because the structure is very complicated and device has a heavy weight. Furthermore, the air conditioning systems contain a pair of drain pipes passed therethrough.

In order to avoid such problems, U.S. Pat. No. 4,597,269, issued to the present inventor, discloses a plastic pan adapted to be mounted to the motor of an air conditioning system which includes a primary pan, a support bracket, height-adjustable brackets, and a motor mount bracket whereby the plastic pan avoids the plugging up of the outlet. However, this primary pan exhibits some problems with regard to convenient and reliable assembling and requires a lot of bolts for installation as well as such primary pan cannot apply a specific air conditioning system containing a pair of drain pipes passed therethrough.

U.S. Pat. No. 4,823,558, issued by the present inventor, discloses a plastic pan assembly for use in air conditioning systems and refrigerators wherein a plastic pan having a raised portion or a rail disposed no the outside surface of the bottom thereof is easily engaged with a channeled supporting bracket. However, this pan assembly cannot apply to a specific air conditioning system containing a pair of drain pipes passed therethrough.

U.S. Pat. No. 4,862,704 issued by the present inventor, discloses an improved primary pan for use in an air conditioning system which includes a C-shaped plastic pan having a raised portion or a rail disposed on the outside surface of the bottom thereof, a channeled supporting bracket having a plurality of elongated apertures for engaging the raised portion of the rail of the plastic pan, and a pair of fan covers having a channel disposed on the outside surface of the top and a circumferential raised portion disposed around a lower outlet thereof for effectively mounting to and separating from the supporting bracket to the plastic pan with only two pairs of screws. However, this pan assembly cannot apply to a specific air conditioning system containing a pair of drain pipes passed therethrough.

U.S. Pat. No. 4,916,919, issued by the present inventor, discloses an improved primary pan for use in an air conditioning system wherein a channeled supporting bracket is utilized to tightly engage and effectively support a plastic pan which includes a drain plastic pan and a plastic support plate which contains a C-shaped circumferential portion and a C-shaped extending portion thereof, the channeled supporting bracket having a plurality of elongated apertures being mounted on a motor and a fan cover, whereby the plastic primary pan assembly can be easily associated with and separate from the air conditioning system and easily adjusted to incline the plastic primary pan for drawing condensate water through an outlet disposed in the plastic primary pan. However, this primary pan cannot apply to a specific air conditioning system containing a pair of drain pipes passed therethrough.

The present invention is also prosecuting a further U.S. patent application Ser. No. 07/431,903, filed Nov. 6, 1989, now U.S. Pat. No. 4,970,875, which disclosed a plastic primary pan containing a pair of blind plates having a pair of semi-cylinders, respectively to be removed one of them from the base primary pan, a pair of rubber packings, and an assembly plate having a pair of semi-cylinders to be inserted into the base primary pan, after taking out one of the pair of blind plates from the base primary pan, assembling with a base primary pan instead of the blind plate so as to pass a pair of built drain pipe therethrough, whereby the plastic primary pan can easily assemble the base primary pan with the assembly plate, the pair of rubber packings, and the pair of drain pipes. However, this primary pan is difficult in assembly by utilizing bolts and nuts.

The present invention is also prosecuting still another U.S. patent application Ser. No. 07/440,259, filed Nov. 22, 1989, now U.S. Pat. No. 4,974,421, which discloses a plastic primary pan assembly for use in conjunction with an air conditioning system which includes a C-shaped drain plastic pan, a pan cover having a raised portion disposed around a blow outlet thereof, and an U-shaped supporting bracket having a pair of locking end members and a pair of elongated channels and an elongated aperture being mounted on the fan cover and a motor through a motor plate, whereby the plastic primary pan assembly can be easily associated with and separate from the air conditioning system and easily adjusted to incline the plastic primary pan for draining condensate water through an outlet disposed in the plastic primary pan. However, this primary pan cannot apply a specific air conditioning system containing a pair of drain pipes passed therethrough.

The present invention is also prosecuting yet another U.S. patent application Ser. No. 07/459,241, filed Dec. 29, 1989, now U.S. Pat. No. 4,978,375, which disclosed a plastic air filter housing assembly for use in air conditioning and heating systems which includes a base member having a pair of round shape longitudinal upper and lower edges and a plurality of transverse frames having a plurality of longitudinal frames to be cross located therewith connecting member and a locking member respectively for pivotably connecting to and slidably locking with the edges respectively, whereby the air filter housing assembly is easily assembled its components and easily replacing the air filter in the air filter housing assembly. However, this primary pan cannot apply a specific air conditioning system containing a pair of drain pipes passed therethrough.

SUMMARY OF THE INVENTION

Accordingly, it is an object of the present invention to provide an improved plastic pan assembly for use in air conditioning systems and refrigerators.

Another object of the present invention is to provide a plastic primary pan which is structured for draining condensate water through an outlet while avoiding the plugging up of the outlet.

Still another object of the present invention is to provide a primary pan which includes two primary plates and a silicone rubber cover are assembled together to form the primary pan which includes a lower cylinder during installation thereof so as to pass a pair of built drain pipes through the lower cylinder.

Yet another object of the present invention is to provide an improved plastic primary pan for utilizing to a specific air conditioning system having a pair of built drain pipes passed therethrough without the use of bolts and nuts.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a primary pan assembly for use in conjunction with an air conditioning system, which includes two primary plates and a silicon rubber cover which are assembled together to form the primary pan which includes a lower cylinder to be disposed at the assembled pan during installation thereof so as to pass a pair of built drain pipes through the lower cylinder, whereby the plastic primary pan can be easily assembled with the silicone rubber plate and tightly attached to the pair of built drain pipes.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
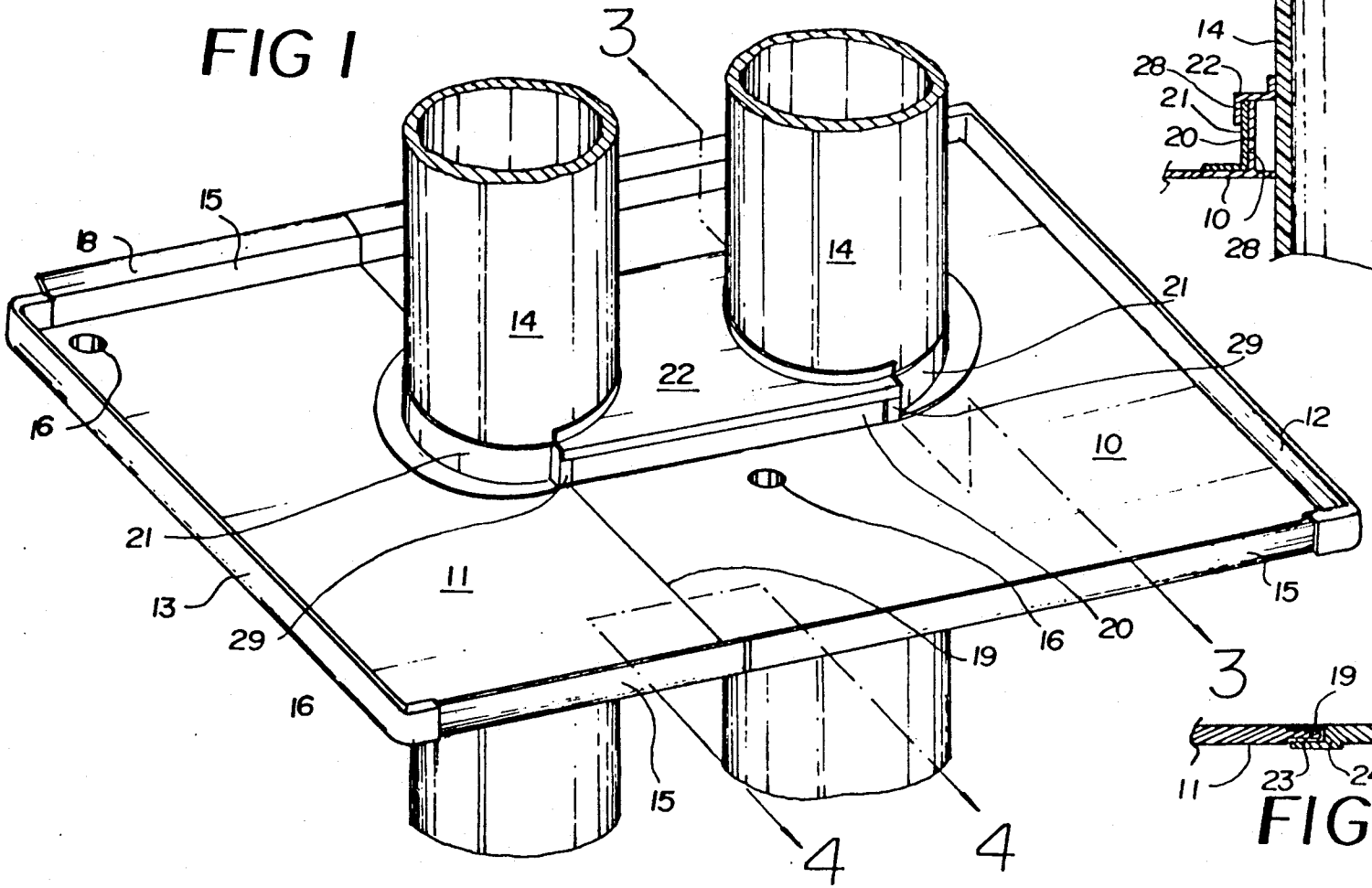
FIG. 1 is a perspective view of the assembled primary pan assembly containing a lower cylinder for receiving built drain pipes therethrough according to the present invention.
Figures 2, 5:
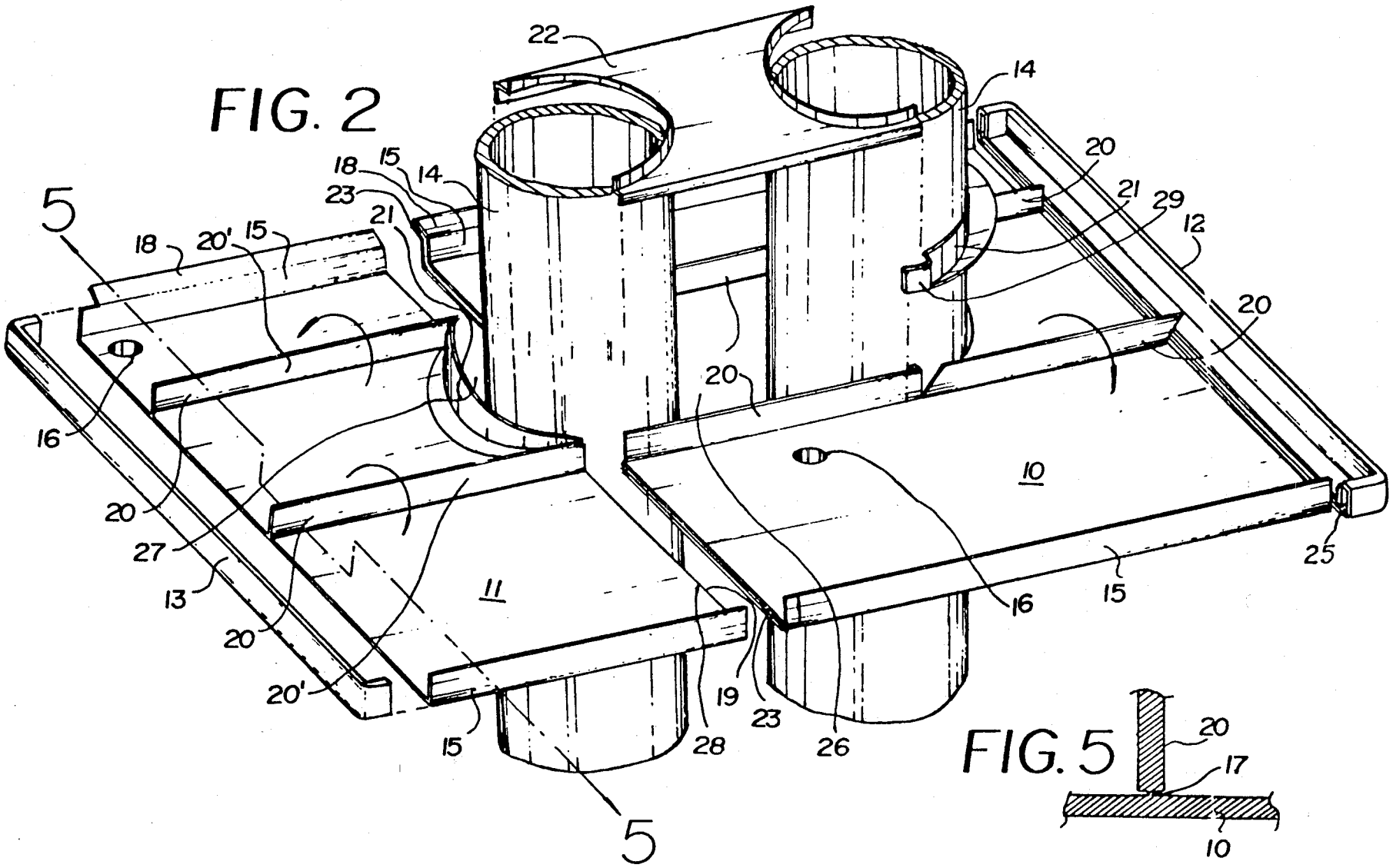
FIG. 2 is an exploded perspective view of showing basic components of the primary assembly of the present invention.
FIG. 5 is a sectional view of FIG. 2, taken along line 5—5.

Referring now in detail to the drawings for the purpose of illustrating preferred embodiments of the present invention, the primary pan assembly as shown in FIGS. 1 and 2, includes a main primary plate 10, an auxiliary primary plate 11, a silicone rubber cover 22, a pair of elongated fixing frames 12 and 13 which are attached to the main and auxiliary primary plates 10 and 11 for forming the primary pan assembly.

The main primary plate 10 includes a plurality of inner inside extension plates 20 and a plurality of outer extension plates 15. As shown in FIG. 5, the inner extension plates 20 are supported on the main primary plate 10 through a weak portion 17, respectively, for easily cutting the weak portion 17 and taking the extension plates 20 out of the main primary plate 10 or easily utilizing as a supporting member. One of both outer extension plates 15 has an additional extension portion 18. One drain hole 16 is disposed on one side of the main primary plate 10.

The auxiliary primary plate 11 includes a plurality of inner extension plates 20' and a plurality of outer extension plates 15. As shown in FIG. 5, the inner extension plates 20' are supported on the auxiliary primary plate 11 through the weak portion 17, respectively, for easily cutting the weak portion 17 and taking the inner extension plates 20' out of the auxiliary plate 11. One of both outer extension plates 15 has an additional extension portion 18. The other drain hole 16 is disposed on one side of the auxiliary primary plate 11. The fixing frames 12 and 13 include an elongated channel 25 for slidably receiving an outside end thereof, respectively, and tightly fixing each other with an adhesive 28 during installation thereof (FIG. 2).

As shown in FIG. 2, the main primary plate 10 includes a main hole 26 which has a rectangular configuration with a semi-circular configuration disposed at one end of the rectangular configuration for slidably receiving a pair of built drain pipes 14. And the auxiliary primary plate 11 includes an auxiliary hole 27 which has a semi-circular configuration to be extended from the main hole 26 during installation thereof. The main and auxiliary holes 26 and 27 are made by cutting the holes 26 and 27 out of the main and auxiliary plates 10 and 11. At this time, the extension plates 20 which are disposed around the hole 26 are made to leave so as to use as a supporting member, while the other extension plates 20 of the plates 10 and 11 are made to cut out of the plates 10 and 11 by cutting the weak portions 17.

Figure 4:
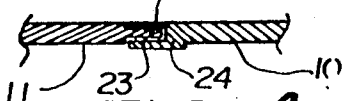
FIG. 4 is a sectional view of FIG. 1, taken along line 4—4.

As shown in FIGS. 2 and 4, each of inside ends of the main and auxiliary primary plates 10 and 11 is fixed to each other through a slot portion 23 disposed at one end of the main primary plate 10 and a projecting portion 19 disposed at one end of the auxiliary primary plate 11. The main primary plate 10 is provided with a raised end portion 24 disposed at the bottom of and in the vicinity of the slot portion 23.

Figure 3:
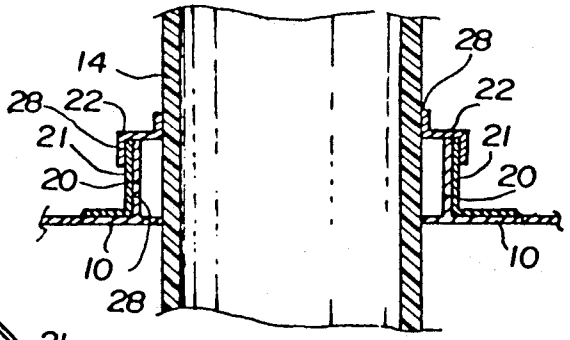
FIG. 3 is a sectional view of FIG. 1, taken along line 3—3.

As shown in FIGS. 1, 2, and 3, after fixing the auxiliary primary plate 11 to the main primary plate 10, a L-shaped semi-circular sealing plate 21 is attached to the semi-circular portion at the lower portion thereof and to left inner extension plates 20 at a pair of extended attaching portion 29 thereof, respectively. Thus when the assembled primary pan is suspended to the air conditioning system at an inclination (not shown), both sealing plates 21 are attached to the built drain pipes 14 with the adhesive 28 (FIG. 3). Thereafter, the silicone rubber cover 22 having a H-shaped configuration is covered with the assembled primary pan with the adhesive 28. Accordingly, the water collected in the primary pan cannot be leaked therethrough and can be easily drained through one of both drain holes 16.

In assembly, first of all, the main primary plate 10 and auxiliary primary plate 11 are formed with the holes 26 and 27 for passing the built drain pipes 14 therethrough during installation thereof. And the inner extension plates 20 and 20' are taken out from the main and auxiliary primary plates 10 and 11 except the inner extension plates 20 disposed around the hole 26.

Second, the main primary plate 10 and the auxiliary primary plate 11 are assembled with each other through the projecting and slot portions 19 and 23 disposed at the inside ends thereof, respectively. Also, the elongated fixing frames 12 and 13 are assembled with the main and auxiliary primary plates 10 and 11 through the elongated channels 25 thereof, respectively. In these cases, the adhesive 28 such as a glue are utilized with fixing portions of the plates 10, 11, 12, and 13 for tightly fixing to each other. Thereafter, the L-shaped, C-shaped sealing plates 21 are attached to the plates 10 and 11 at the semi-circular circumferential portions of the holes 26 and 27 of the plates 10 and 11 so that the sealing plates 21 and both left extension plates 20 are formed a lower cylinder for slidably receiving the built drain pipes 14.

Third, the assembled primary pan is suspended to the air conditioning system at an inclination (not shown) for easily draining condensate water through one of the drain holes 16 as well as the built drain pipes 14 are adapted to engage with the holes 26 and 27 of the main and auxiliary primary plates 10 and 11. Thereafter, the silicone rubber cover 22 is covered between the built drain pipes 14.

Thus the primary pan assembly according to the present invention is utilized with the air conditioning system without the use of bolts and nuts when compared with the conventional primary pan assembly. Therefore, the primary pan assembly is simple in construction, economical to manufacture, durable in use, and refined in appearance.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A primary pan assembly for use in conjunction with air conditioning system, which comprises:

a main primary plate provided with one outlet disposed on one side thereof and a plurality of inner extension plates extending from the inner portions thereof and a plurality of outer extension plates extending from the outer edge portions thereof, said main primary plate provided with an elongated slot disposed at the inside end thereof, an auxiliary primary plate provided with another outlet disposed on one side thereof and a plurality of inner extension plates extending from the inner portions thereof and a plurality of outer extension plates extending from the outer edge portions thereof, said auxiliary primary plate provided with an elongated projecting member disposed at the inside end thereof for engaging with said elongated slot of the main primary plate, a pair of frames having an elongated channel for tightly receiving one end of said main and said auxiliary primary plates, respectively, for assembling said main and auxiliary primary plates to form an assembled plate, an elongated hole having a semi-circular portion disposed both ends thereof and disposed in said assembled plate for receiving a pair of built drain pipes, a pair of sealing plates having a L-shaped and C-shaped configuration for attaching on both semi-circular portions of said hole and forming a lower cylinder with said inner extension plates disposed on the main primary plate, a silicone rubber cover having an approximately H-shaped configuration for covering the elongated hole disposed in said assembled plate between the pair of built drain pipes, whereby the plastic primary pan assembly mounted to the air conditioning system at an inclination for easily draining the condensate water through the outlet forms a lower cylinder so as to pass the built drain pipes therethrough and the silicone rubber cover can be smoothly covered between the built drain pipes.

2. The primary pan assembly of claim 1, wherein the plurality of inner extension plates disposed on said main primary plate have a weak portion, respectively for easily cutting the weak portion and taking the inner extension plate out of the main primary plate, and leaving them as a supporting member so as to assemble with the sealing plates to form the lower cylinder.

3. The primary pan assembly of claim 2, wherein the plurality of inner extension plates disposed on said auxiliary primary plate have the weak portion, respectively for easily cutting the weak portion and taking the inner extension plate out of the auxiliary primary plate.

4. The primary pan assembly of clalim 1, wherein the main and auxiliary primary plates are assembled with each other with an adhesive.

5. The primary pan assembly of claim 1, wherein the main and auxiliary primary plates are assembled with the pair of elongated frames with the adhesive.

6. The primary pan assembly of claim 1, wherein the pair of sealing plates are assembled with the main and auxiliary primary plates with the adhesive.

7. The primary pan assembly of claim 1, wherein the main and auxiliary primary plates are made of plastic.

* * * * *